US007175318B2

(12) United States Patent
Booty, Jr.

(10) Patent No.: US 7,175,318 B2
(45) Date of Patent: Feb. 13, 2007

(54) COMPACT FLASHLIGHT

(76) Inventor: Donald J. Booty, Jr., 5522 E. Dusty Wren Dr., Cave Creek, AZ (US) 85331

( * ) Notice: Subject to any disclaimer, the term of this patent is extended or adjusted under 35 U.S.C. 154(b) by 159 days.

(21) Appl. No.: 10/955,041

(22) Filed: Sep. 30, 2004

(65) Prior Publication Data

US 2006/0072308 A1 Apr. 6, 2006

(51) Int. Cl.
*F21V 21/088* (2006.01)
*F21V 21/30* (2006.01)

(52) U.S. Cl. ..... 362/396; 362/199; 362/203; 362/208

(58) Field of Classification Search ..... 362/396, 362/203, 208, 199
See application file for complete search history.

(56) References Cited

U.S. PATENT DOCUMENTS 2,561,744 A 7/1951 Langdon et al.
3,992,596 A 11/1976 Miller
4,399,498 A * 8/1983 Bacevius ..... 362/396
5,541,816 A 7/1996 Miserendino
5,855,429 A 1/1999 Webb, Jr. et al.
5,957,567 A 9/1999 Kish et al.
6,012,827 A 1/2000 Caplan et al.
6,142,644 A 11/2000 Leung
6,206,543 B1 3/2001 Henry
6,299,323 B1 10/2001 Yu et al.
6,357,890 B1 3/2002 Parsons et al.
6,394,621 B1 5/2002 Hanewinkel, III
6,454,426 B1 9/2002 Altman
2003/0231491 A1* 12/2003 Shih ..... 362/199

OTHER PUBLICATIONS

Herrington Catalog, Feb. 2003, p. 48.
Aurora Ultra Super Bright LED Mini-Flashlight, Marketing Brochure, 2001.
Victor Gloria Development LTD., Super Bright Key Chain With Flash, Advertisment, Nov. 2002.
Herrington Catalog, Ultra Light advertisment, p. 25.
http://wei.rei.com, visited Jan. 23, 2003.
http://www.sapphirelight.co.uk/elite.htm, visited Jan. 23, 2003.
http://www.cmgequipment.com/04_New.htm, visited Jan. 23, 2003.
http://www.ptsprotlights.com/whatsnew.html, visited Jan. 23, 2003.

* cited by examiner

*Primary Examiner*—Sandra O'Shea
*Assistant Examiner*—James W Cranson, Jr.

(57) ABSTRACT

A compact flashlight is configured such that it can be coupled to a key ring, as well as various other devices, and includes a locking mechanism that inhibits accidental opening and detachment from the ring or other device. The compact flashlight is further configured to allow the flashlight to be pointed in numerous directions while resting on a surface, and further allows for ease of battery replacement. The compact flashlight additionally includes a plurality of switches that are easy to operate, and includes both a momentary switch and an on-off switch.

10 Claims, 11 Drawing Sheets

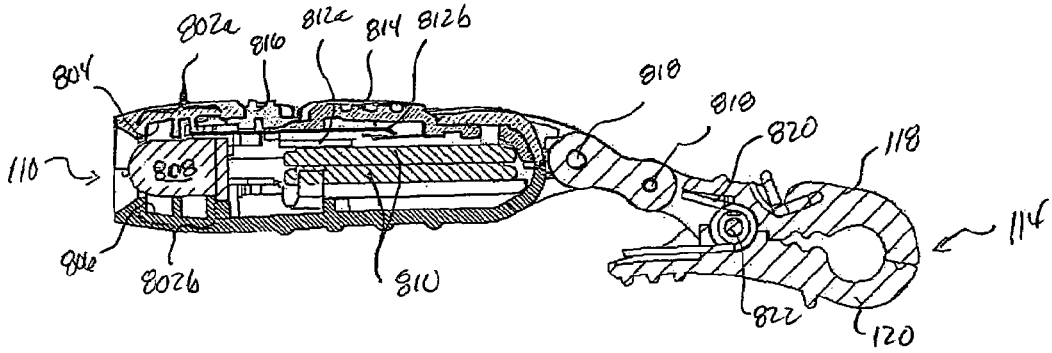
*Fig.* 8
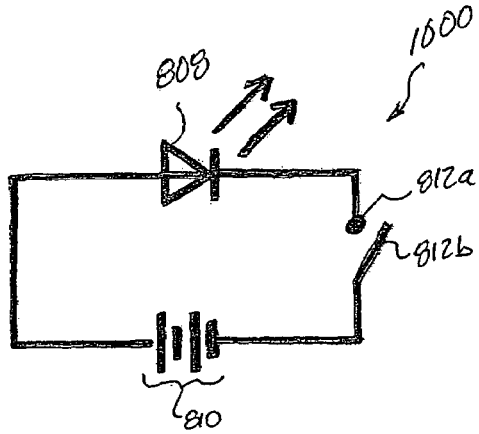
*Fig.* 10

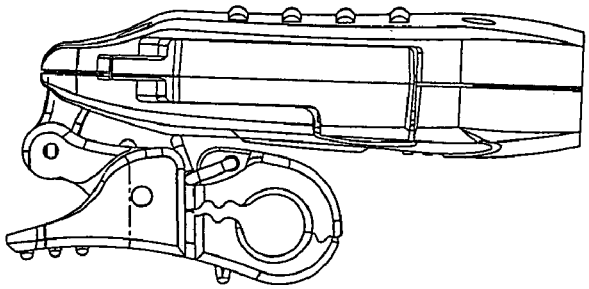
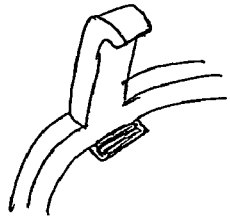
FIG. 13
*Fig. 14*
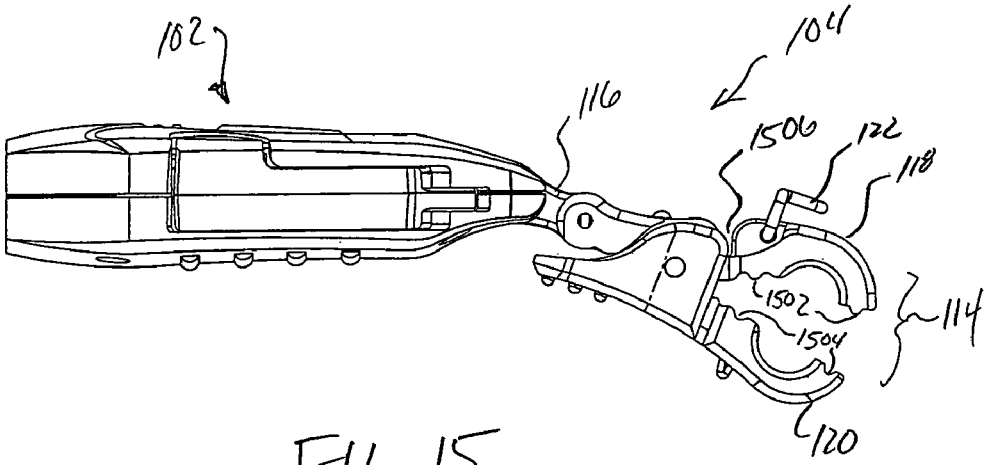
FIG. 15

COMPACT FLASHLIGHT

TECHNICAL FIELD

The present invention relates to flashlights and, more particularly, to a compact flashlight that may be coupled to various objects, such as a key ring, a book, or a hat, and that includes an improved switch configuration and a battery holder that allows for relatively easy battery installation and replacement.

BACKGROUND

A flat tire on a dark, lonely road. A blown fuse or tripped circuit breaker on a dark, stormy night. The desire to find a dropped object on the floor of a darkened theater. Many individuals have experienced one or more of these events. During these events, it many times seems inevitable that a flashlight is either unavailable or cannot be found. Moreover, if a flashlight is available or found, its batteries may be depleted. Thus, in recent years many manufacturers have developed and marketed compact flashlights that can be carried in, for example, a persons pocket or purse.

Many of the compact flashlights that are presently known include a light emitting diode (LED) that is powered from one or more small batteries. The LED and batteries are housed within a relatively small, compact housing that can easily fit in most pockets and/or purses. In addition, many presently known compact flashlights include a ring or other type of extension that allows the flashlight to be coupled to a key ring.

The presently known compact flashlights are convenient, safe, and relatively easy to use. Nonetheless, most suffer certain drawbacks. For example, while the rings and extensions allow for coupling to a key ring, most do not allow the flashlight to be coupled to other devices. Moreover, many of the rings and extensions do not include locks or other devices to inhibit accidental opening and detachment from the ring or extension. Furthermore, most compact flashlights presently do not include rotatable structures that allow the flashlight to be pointed in various directions, while resting on a surface.

In addition to the configurational drawback described above, it is noted that many of the present compact flashlights do not provide a convenient way to change the batteries. Indeed, if the batteries can be changed at all, in many instances this requires that the housing be disassembled and reassembled following battery replacement. This operation can be tedious, time confusing, difficult, and can also result in a loss of parts.

Yet another drawback of many presently known compact flashlights is the switches that are used to turn the LED on and off. In many cases, the switches are either permanent-type on/off switches, or momentary-type on/off switches. The permanent-type on/off switches are typically quite small, and can be difficult to operate. In addition, when the flashlights are assembled, precise positioning of the components within the housing, including the switch, is needed for proper operation. Thus, if the batteries are replaced, when the housing is reassembled the switch may fail, or may not operate properly upon reassembly of the housing.

Hence, there is a need for a compact flashlight that can be coupled to a key ring, as well as various other devices, and that includes a locking mechanism that inhibits accidental opening and detachment from the ring or extension, and/or is structurally configured to allow the flashlight to be pointed in numerous directions while resting on a surface, and/or allows for ease of battery replacement, and/or includes one or more switches that are easy to operate. The present invention addresses one or more of these needs.

BRIEF SUMMARY

The present invention provides a compact flashlight that can be coupled to a key ring, as well as various other devices, and that includes a locking mechanism that inhibits accidental opening and detachment. The compact flashlight is configured to allow the flashlight to be pointed in numerous directions while resting on a surface. The compact flashlight also provides for easy battery replacement, and includes a plurality of switches that are easy to operate.

In one embodiment, and by way of example only, a flashlight includes a housing assembly, a light, a battery holder, and a switch. The housing assembly has at least one aperture formed therein. The light is mounted at least partially within the housing assembly and extends at least partially through the housing assembly aperture. The battery holder is rotationally mounted on the housing assembly and is rotatable between at least an open position and a closed position. The first switch is disposed on the housing assembly and is configured to move between an activate position and a deactivate position, to thereby electrically energize and de-energize, respectively, the light when one or more batteries are installed in the battery holder.

In another exemplary embodiment, a flashlight includes a housing assembly, a light, a battery holder, a switch, and a clip. The housing assembly has at least one aperture formed therein. The light is mounted at least partially within the housing assembly and extends at least partially through the housing assembly aperture. The battery holder is disposed within the housing assembly and is adapted to receive one or more batteries therein. The switch is disposed on the housing assembly and is configured to move between at least an activate position and a deactivate position, to thereby electrically energize and de-energize, respectively, the light from the battery when one or more batteries are installed in the battery holder. The clip is rotationally coupled to the housing assembly and has at least a closed position and an open position. The clip includes a first jaw, a second jaw, and a spring. The first jaw has at least an inner surface and an outer surface. The second jaw is rotationally coupled to the first jaw and has at least an inner surface and an outer surface and is adapted to rotate relative to the first jaw. The spring is coupled between the first and second jaws and is configured to bias the clip toward the closed position, whereby at least a first portion of the first jaw inner surface engages at least a first portion of the second jaw inner surface.

In yet another exemplary embodiment, a flashlight includes a housing assembly, a light, a battery holder, a first switch, and a second switch. The housing assembly has at least one aperture formed therein. The light is mounted at least partially within the housing assembly and extends at least partially through the housing assembly aperture. The battery holder is disposed within the housing assembly and is adapted to receive one or more batteries therein. The first switch is movably disposed on the housing assembly and is configured to move between at least an activate position and a deactivate position, to thereby electrically energize and de-energize, respectively, the light from the battery when one or more batteries are installed in the battery holder. The second switch is movably disposed on the housing assembly and is configured to move between at least (i) an on position, in which the second switch engages the first switch and moves it to its activate position, and (ii) an off position, in which the second switch is disengaged from the first switch.

These and other features and advantages of the preferred flashlight will become apparent from the following detailed description taken in conjunction with the accompanying drawings which illustrate, by way of example, the principles of the invention.

BRIEF DESCRIPTION OF THE DRAWINGS

FIGS. 8 and 9 are cross section views of the compact flashlight shown in FIG. 1;

FIG. 10 is a simplified schematic representation of a light circuit incorporated into the compact flashlight of the compact flashlight shown in FIG. 1;

FIG. 13 is a perspective view of a portion of the structure used to implement the battery holder;

FIG. 14 is a side view of the compact flashlight illustrating the rotation of the clip;

FIG. 15 is a side view of the compact flashlight depicting the clip in more detail;

DETAILED DESCRIPTION OF PREFERRED EMBODIMENTS

Figure 1:
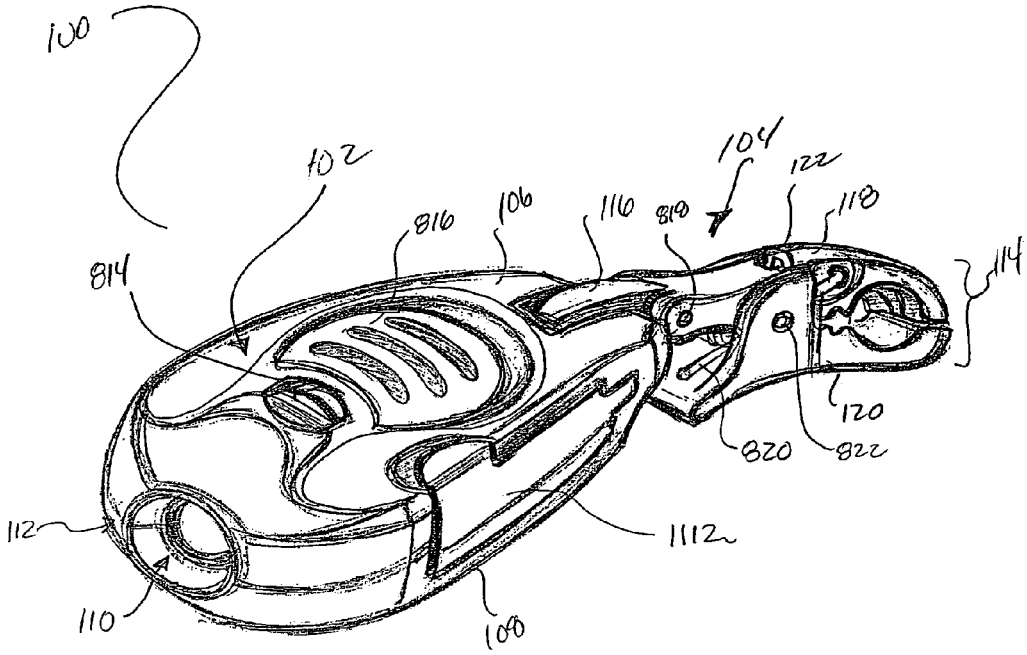
FIG. 1 is a perspective view of a compact flashlight according to an exemplary embodiment of the present invention.
Figure 16:
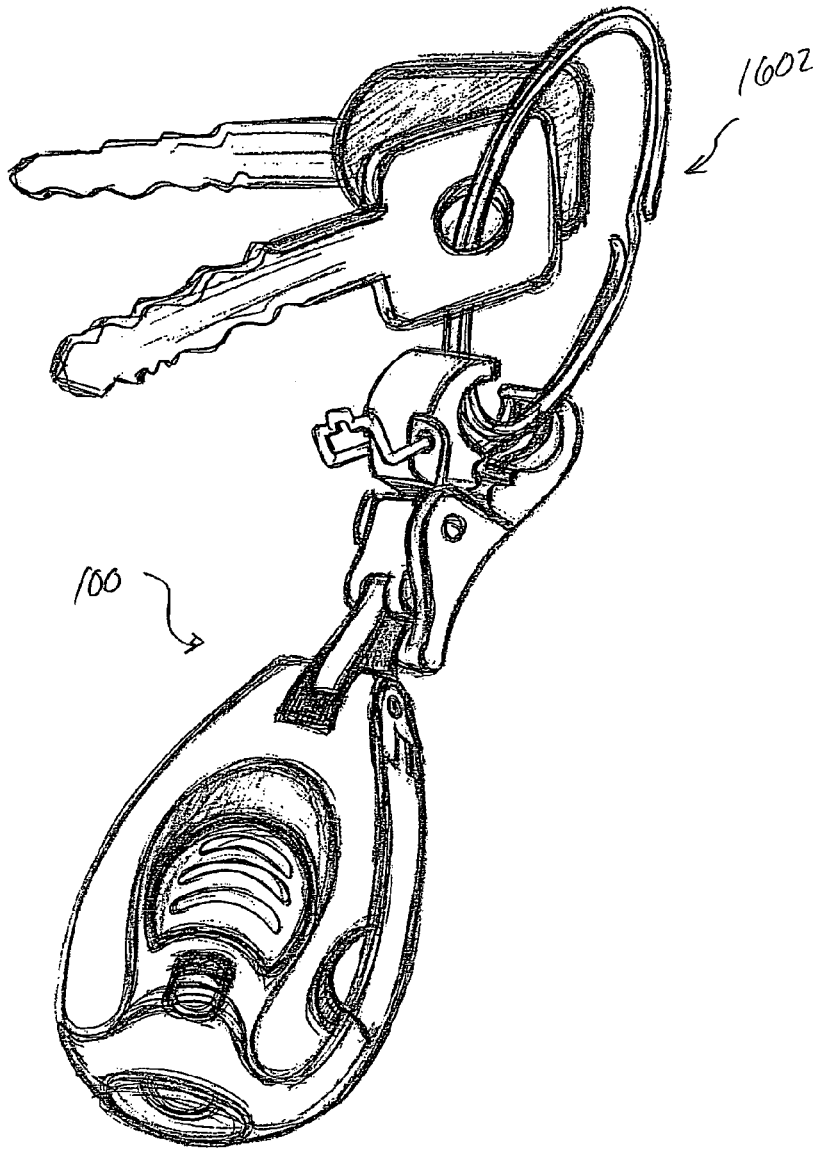
FIG. 16 is a perspective view of the compact flashlight showing it being clipped to a keyring.

A perspective view of a particular preferred embodiment of a compact flashlight 100 is shown in FIG. 1, and includes a housing assembly 102, and a clip assembly 104. The housing assembly 102 houses various components, many of which are described more fully below, and is preferably sized and dimensioned to fit within a conventional pant pocket, purse, or other relatively small carrying device. The clip assembly 104 is rotationally coupled to the housing assembly 102 and is used to couple the flashlight 100 to one or more devices. For example, as shown in FIG. 16, the clip 104 may be used to couple the flashlight 100 to a keyring 1602. The housing assembly 102 and the clip assembly 104, and the components that make up each assembly, will now each be described in detail, beginning first with the housing assembly 102.

Turning now to FIGS. 2–7, which depict top, bottom, side, and end views of the flashlight 100, in combination with FIG. 1, it is seen that the housing assembly 102 includes an upper housing section 106, and a lower housing section 108. The upper 106 and lower 108 housing sections are coupled together by, for example, a plurality of fasteners 302 (see FIG. 3), though it will be appreciated that these sections could also be coupled together using other means such as, for example, an adhesive, or a snap-fit.

The upper 106 and lower 108 housing sections are configured such that when each are coupled together, the housing assembly 102 includes an aperture 110 formed in a first end 112 of the housing assembly 102 (see FIG. 1). With reference now to FIG. 8, the upper 106 and lower 108 housing sections also preferably each include a mount collar 802*a*, 802*b* on respective inner surfaces 804, 806 thereof A light 808, which is preferably a light emitting diode (LED), is mounted within the housing assembly 102 and is supported within the housing via the mount collars 802*a*, 802*b*. The light 808, when mounted within the housing assembly 102, preferably extends only partially through the aperture 110, and is thus recessed within the housing assembly 102. This preferred configuration, in which the light 808 is recessed within the housing assembly 102, helps protect the light 808 from external, potentially damaging hazards. It will be appreciated, of course, that this is merely exemplary a particular preferred configuration, and that the light 808 could extend beyond the perimeter of the housing assembly 102.

With continued reference to FIG. 8, and as was previously noted, it is seen that, in addition to the light 808, various other components are housed within, and mounted on, the housing assembly 102. These components include one or more batteries 810, a pair of switch contacts 812*a*, 812*b*, a first switch 814, and a second switch 816. The batteries 810, which in the depicted embodiment are two lithium coin-type batteries, are used to supply power to the light 808 when either of the switches 814, 816 is activated. It will be appreciated that the type of battery used may vary, and that lithium coin-type batteries is merely exemplary of a particular preferred embodiment. No matter the particular type or number of batteries, and as will be described in more detail further below, the batteries 810 are preferably mounted in a rotatable battery compartment that allows ready access to, and removal and/or replacement of, the batteries 810. As may be seen, when the light 808 and batteries 810 are properly mounted within the housing assembly 102, the light 808 is electrically coupled in series between the batteries 810 and one of the switch contacts 812*a*.

The switch contacts 812*a*, 812*b* are which are formed of any one of numerous electrically conductive materials such as, for example, nickel-plated phosphorus, bronze, nickel-plated steel, gold-plated steel, and brass, are mounted within the housing assembly 102 and include a fixed switch contact 812*a*, and a movable switch contact 812*b*. The fixed switch contact 812*a* is preferably, though not necessarily, non-movable, and is configured to be electrically coupled to the batteries 810 when the batteries 810 are properly mounted and disposed within the housing assembly 102. The movable switch contact 812*b*, as the term used herein connotes, is selectively movable. In particular, the movable switch contact 812*b* is selectively movable between a contact position and a non-contact position. In the non-contact position, which is the normal position, the movable switch contact 812*b* is electrically isolated from the fixed switch contact 812*a*. Conversely, in the contact position, the movable switch contact 812*b* is electrically coupled to the fixed switch contact 812*a*.

The movable switch contact 812*b* may be configured in any one of numerous ways to implement the above-described functionality. However, in the depicted embodiment this is accomplished by coupling one end of the moveable switch contact 812*b* to the first switch 814 and another end of the movable switch contact 812*b* to the housing assembly 102. The movable switch contact 812*b* is also configured such that when it and the light 808 are properly disposed within the housing assembly 102, the light 808 is electrically coupled to the movable switch contact 812*b*.

With the above-described switch contact configuration, and as is shown more clearly in schematic form in FIG. 10, the batteries 810, the light 808, and the switch contacts 812*a*, 812*b* form a series electrical circuit 1000. Thus, when the movable switch contact 812*b* is moved to the contact position, it is electrically coupled to the fixed switch contact 812*a*, thereby closing the circuit 1000 and allowing the batteries 810 to supply current to the light 808, which causes the light 808 to illuminate. As will now be described, the movable switch contact 812*b* is moved between the contact and non-contact position by operation of either the first 814 or second 816 switches.

Figure 2:
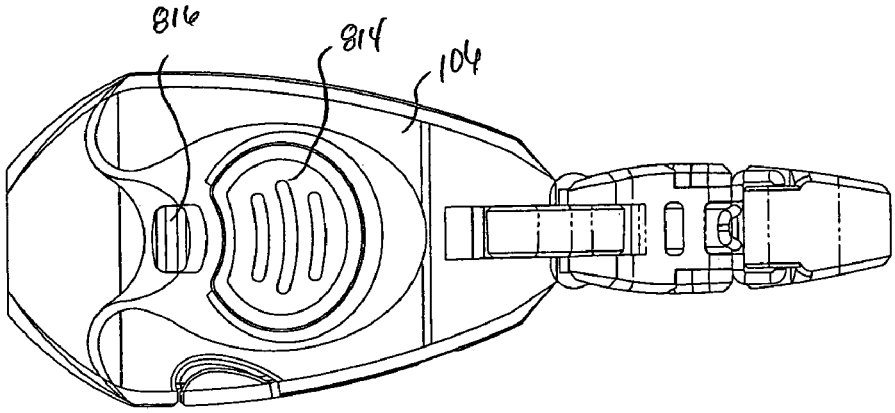
FIGS. 2 and 3 are a top and bottom views, respectively, of the compact flashlight shown in FIG. 1.
Figure 3:
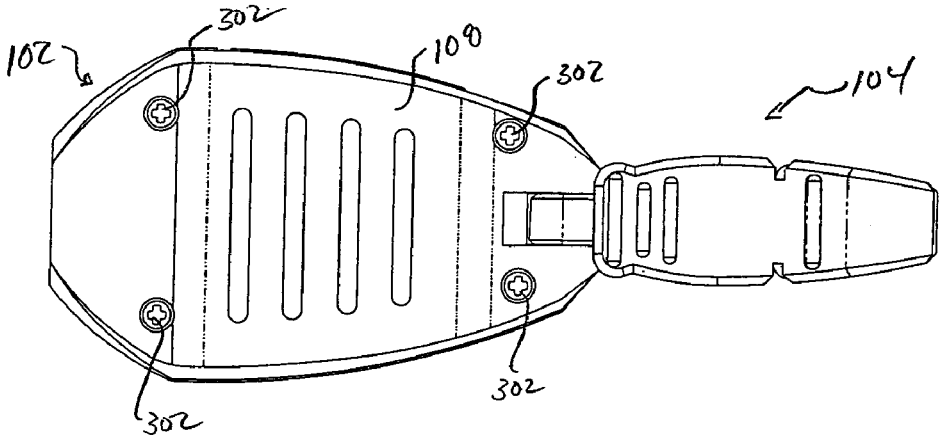
Figure 4:
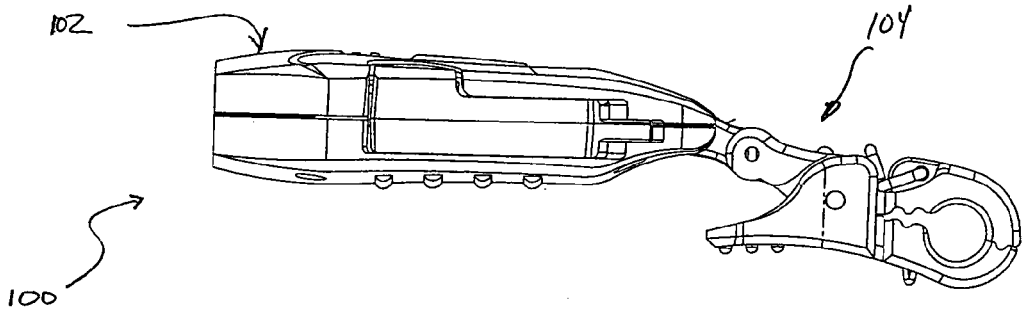
FIGS. 4 and 5 are sides views of the compact flashlight shown in FIG. 1.
Figure 5:
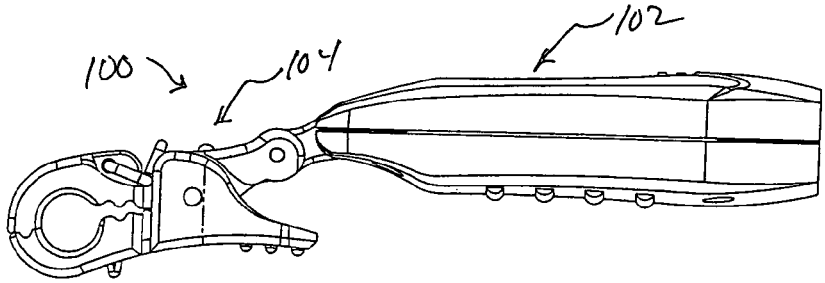
Figure 6:
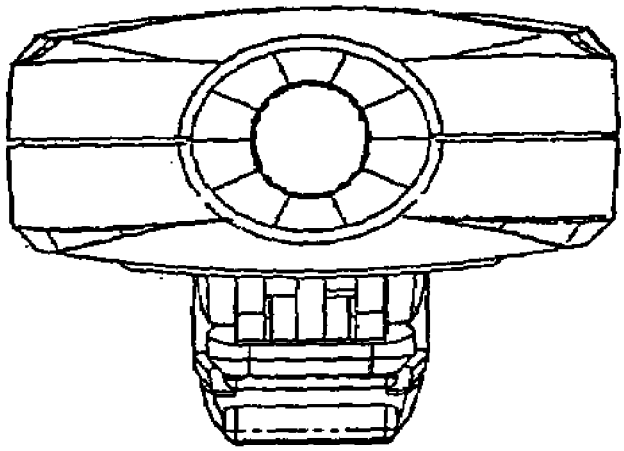
FIGS. 6 and 7 are end views of the compact flashlight shown in FIG. 1.
Figure 7:
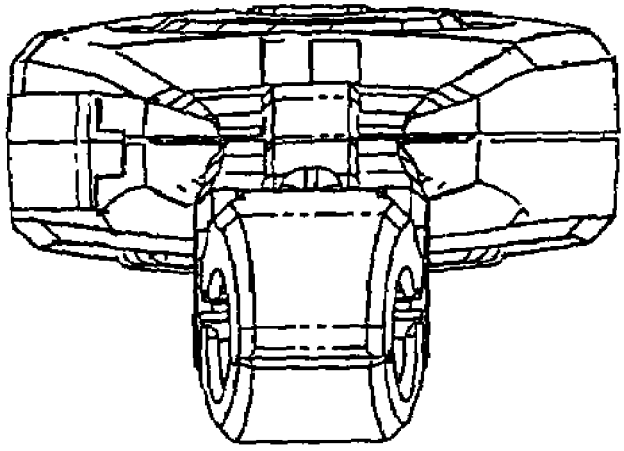

Returning once again to FIG. 8, and with additional reference to FIGS. 1 and 2, it was previously noted that the housing assembly 102 includes two switches, a first switch 814, and a second switch 816. The first switch 814, which is referred to hereinafter as a momentary switch 814, is coupled to the housing assembly upper section 106 in a cantilever fashion and is movable between a deactivate position and an activate position. The momentary switch 814 is configured to be self-biased toward the deactivate position and, in response to a small force, to move to the activate position. As was just noted, the momentary switch 814 is also coupled to the movable switch contact 812*b*. When the momentary switch 814 is in the deactivate position, which is the position shown in FIG. 8, the movable switch contact 812*b* is in its non-contact position, and is electrically isolated from the fixed switch contact 812*a*. Conversely, when the momentary switch 814 is in its activate position, it moves the movable switch contact 812*b* to its contact position, electrically coupling the fixed 812*a* and movable 812*b* switch contacts together, closing the electrical circuit 1000, and causing the light 808 to illuminate.

The second switch 816, which is referred to hereinafter as the on-off switch 816, is slidably disposed within the housing assembly upper section 106. Similar to the momentary switch 814, the on-off switch 816 is movable between two positions, an on position and an off position; however, unlike the momentary switch 814, the on-off switch 816 is not biased toward either position. Rather, the on-off switch 816 is configured such that, once it is moved to either the on or off position, it will remain in that position until it is moved to the other position. In particular, and as will now be described, when the on-off switch is moved to the on position, it engages the momentary switch 814 and moves the momentary switch to its activate position, thereby illuminating the light 808.

The on-off switch 816 and momentary switch 814 are shown in the off position and the deactivate position, respectively, in FIG. 8. If it is desired to keep the light 808 energized for an extended period, or for any period of time for that matter, without having to continuously apply pressure manually to the momentary switch 814, then the on-off switch is moved to the on position. When this occurs, as is shown most clearly in FIG. 9, the on-off switch 816 engages the momentary switch 814, moving it to the activate position. As was noted above, when the momentary switch 814 is in the activate position, it moves the movable switch contact 812*b* into electrical contact with the fixed switch contact 812*a*, which causes the light 808 to illuminate. As was also noted above, the on-off switch will remain in the on position until it is manually moved to the off position.

Figure 11:
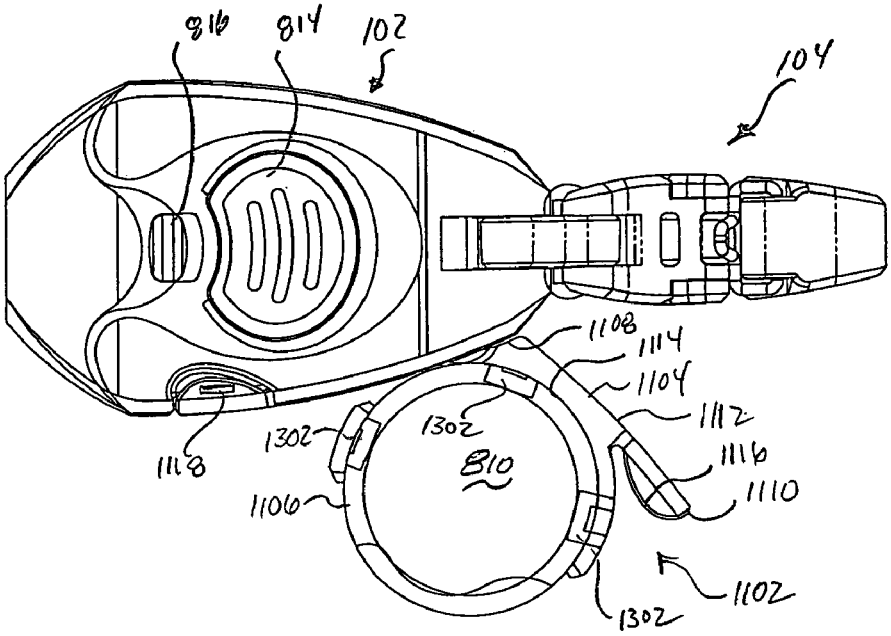
FIGS. 11 and 12 are top and bottom views of the compact flashlight shown in FIG. 1, with a battery holder in the open position.
Figure 12:
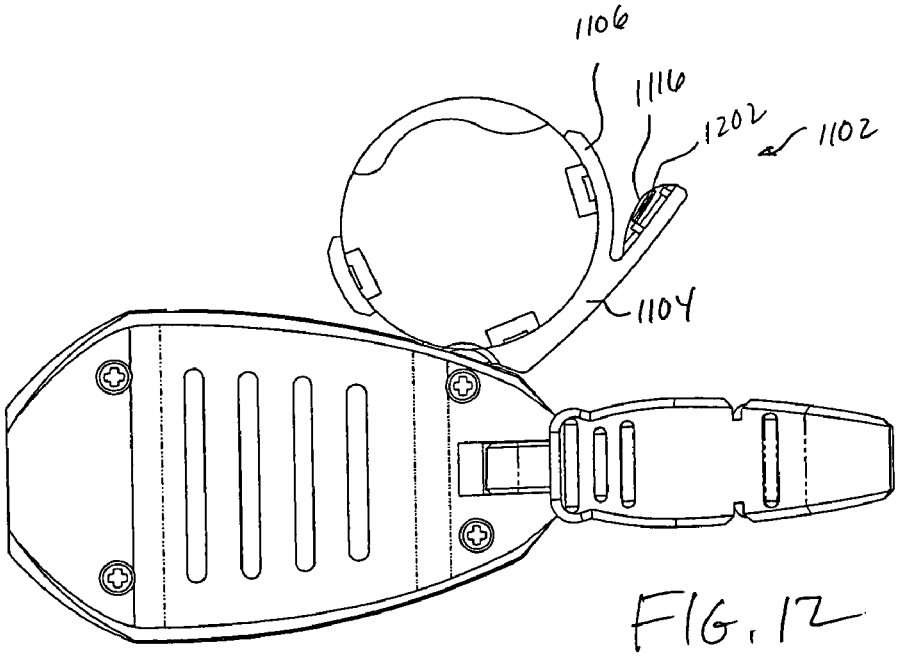

It was previously noted that the batteries 810 are preferably mounted in a rotatable battery compartment. Turning now to FIGS. 11 and 12, and with reference to FIG. 1 as necessary, the battery holder will be described in more detail. As shown in FIGS. 11 and 12 the battery holder 1102 is rotationally mounted on the housing assembly 102 and is movable between an open position, which is shown in FIGS. 11 and 12, and a closed position, which is shown in FIG. 1. The battery holder 1102 may be rotationally mounted using any one of numerous types of devices, but in the depicted embodiment is rotationally mounted using a non-illustrated sleeve that surrounds one of the fasteners 302. No matter the particular manner in which the battery holder 1102 is rotationally mounted, it is seen in FIGS. 1, 11, and 12 that when the battery holder 1102 is in the open position, it extends away from the housing assembly 102, exposing the batteries 810. Conversely, when the battery holder 1102 is in the closed position, the battery holder 1102 is disposed at least partially within the housing assembly 102, such that the batteries 810 are enclosed therein. A more detailed description of the battery holder 1102 will now be provided.

In the depicted embodiment, the battery holder 1102 includes a pivot arm 1104, and a battery mount structure 1106. The pivot arm 1104 includes a first end 1108, a second end 1110, an outer surface 1112, and an inner surface 1114. The pivot arm first end 1108 is rotationally mounted to the housing assembly 102. The pivot arm second end 1110 has a tab 1116 formed thereon that cooperates with the upper housing section 106 to hold the battery holder 1102 in the closed position. In particular, and as shown in FIG. 12, the tab 1116 has a post 1202 formed on its underside that cooperates with a similarly configured post 1118 formed on the upper housing section 106 to hold the battery holder 1102 in the closed position in a snap-fit manner. The pivot arm outer surface 1112 is configured such that when the battery holder 1102 is in the closed position, as shown in FIG. 1, the outer surface 1112 is substantially flush with the housing assembly 102.

The battery mount structure 1106 extends from the pivot arm 1104 inner surface and, as was alluded to above, is disposed within the housing assembly 102 when the battery holder 1102 is in the closed position. The battery mount structure 1106 is used to hold one or more batteries 810. To do so, as is shown most clearly in FIG. 13, the battery mount structure 1106 includes a plurality of snap-fit posts 1302 that extend substantially perpendicularly therefrom. When the batteries 810 are disposed within the battery holder 1102, the batteries 810 are held in place on the battery mount structure 1106 via the snap-fit posts 1302, which are flexible enough to allow the batteries 810 to be easily installed, yet rigid enough to hold the batteries 810 in place once the batteries have been installed.

Returning once again to FIG. 1, as was noted above, the flashlight 100 additionally includes the clip assembly 104, which is rotationally mounted to the housing assembly 102. The clip assembly 104, as was previously noted, may be used to couple the flashlight 100 to one or more devices. Moreover, as will be explained further below, the clip assembly 104 may additionally be used to position the flashlight 100 on a surface and to point the light 808 in a desired direction. However, before describing each of these exemplary end-uses, a more detailed description of the structure of a particular preferred embodiment of the clip assembly 104 will first be provided. In doing so, reference should once again be made to FIGS. 1, 8, and 9, as necessary.

With continued reference first to FIG. 1, it is seen that the clip assembly 104 includes a clip 114 and a connection arm 116. The clip 114 is rotationally coupled to the connection arm 116, which is in turn rotationally coupled to the housing assembly 102. It will be appreciated that the clip 114 and connection arm 116 may be rotationally coupled in any one of numerous ways. However, in the depicted embodiment, and as shown more clearly in FIGS. 8 and 9, hinge pins 818 are used. The hinge pins 818 are configured such that the clip 114 and the connection arm 116 may rotate, each with one degree-of-freedom, relative to the connection arm 116 and the housing assembly 102, respectively, as is shown in FIG. 14. It will be appreciated that configuring the clip 114 and connection arm 116 to rotate as depicted and described herein is merely exemplary, and that either or both could be configured to rotate with multiple degrees-of-freedom.

Figure 9:
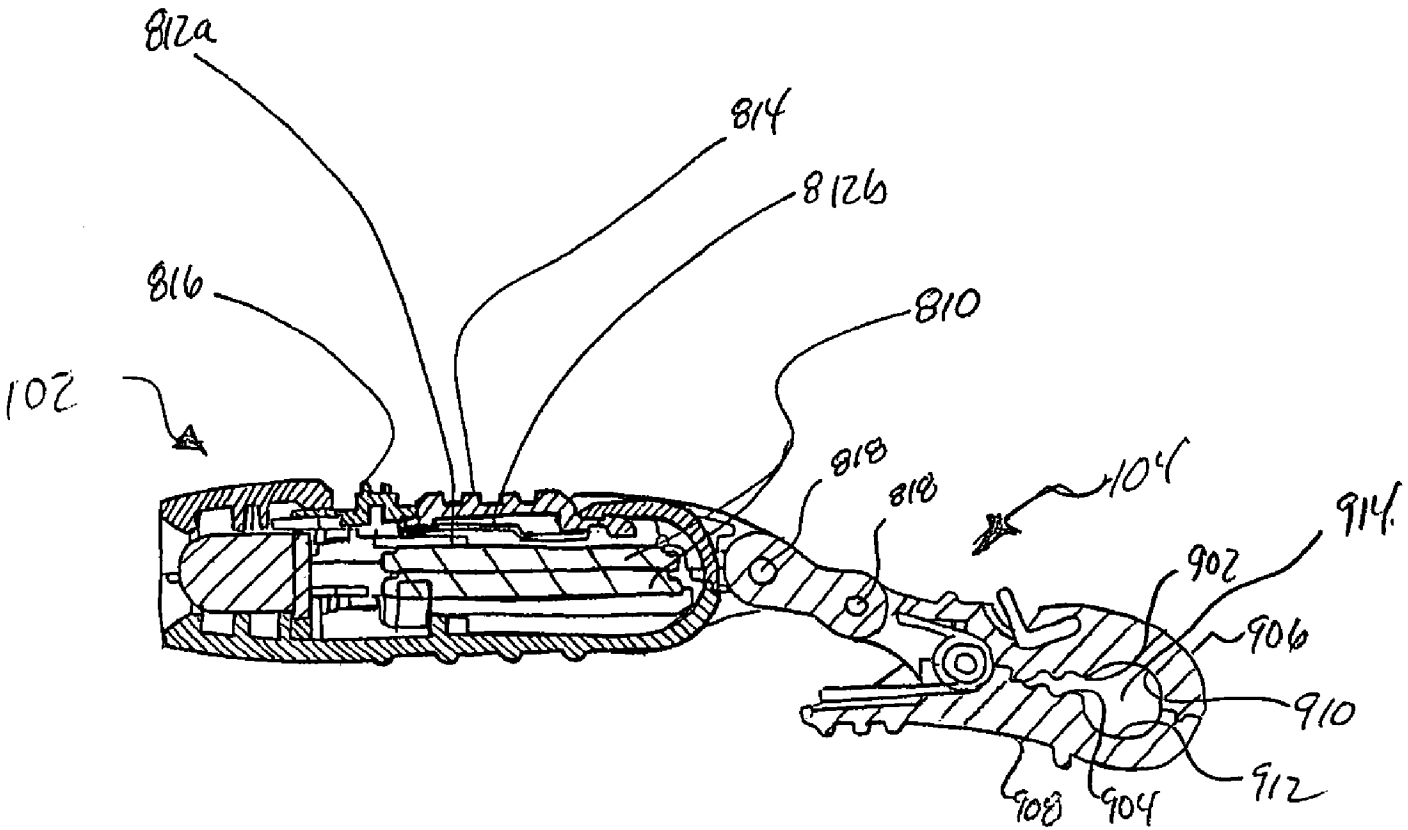

With continued reference to FIG. 1,in combination with FIGS. 8 and 9, it is seen that the clip 114 includes at least two jaws, an upper jaw 118 and a lower jaw 120, and additionally includes a bias spring 820 (see FIG. 8). The upper 118 and lower 120 jaws are rotationally coupled to one another via, for example, another hinge pin 822, and are configured to rotate relative to one another. More specifically, in the depicted embodiment, the lower jaw 120 is rotationally coupled to the upper jaw 118, and is configured to rotate relative to the upper jaw 118. The upper 118 and lower 120 jaws each include an inner surface 902 and 904, respectively, and an outer surface 906 and 908, respectively (see FIG. 9).

As may be readily appreciated, the clip 114 is movable between a closed position, which is shown in FIGS. 8 and 9, and an open position, which is shown in FIG. 15. In the closed position, the upper and lower jaw inner surfaces 902, 904, or at least portions thereof engage one another. In the depicted embodiment, the upper and lower jaw inner surfaces 902, 904 each include a plurality of lands 1502 and grooves 1504, one or more of which, as shown in FIG. 15, mate with one another when the clip 114 is in the closed position. The depicted clip 114 is also configured such that the upper and lower jaw inner surfaces 902, 904 each include a substantially semi-circular groove 910, 912. The grooves 910, 912 are preferably located on the upper and lower jaw inner surfaces 902, 904 so that when the clip 114 is in the closed position, as shown in FIGS. 8 and 9, the grooves 910, 912 form a substantially circular opening 914 through the clip 114.

The bias spring 820 is coupled to the upper 118 and lower 120 jaws and is configured to bias the clip 114 toward the closed position. Thus, in order to move the clip 114 to the open position, the bias force supplied by the bias spring 820 must first be overcome by an externally applied force. Preferably, the bias spring 820 is configured such that the bias force it supplies may be readily overcome manually. That is, the force exerted by the thumb and forefinger, for example, of a typical person may overcome the bias force, and move the clip 114 to the open position. As may be appreciated, once the externally applied force is removed, the clip 114 will snap toward the closed position.

In some instances it may not be desirable for the clip 114 to be readily, or easily, moved from the closed to the open position. Thus, the clip 114 additionally includes a lock 122. In the depicted embodiment, the lock 122, which in the depicted embodiment is a metal ring, is rotationally coupled to the clip upper jaw 118, and is movable between a locked position, shown in FIGS. 1–9, and an unlocked position, which is shown in FIG. 15. With continued reference to FIG. 15, it is seen that a lock groove 1506 is formed in the upper jaw 118, and is configured to releasably engage the lock 122 when in the locked position. The lock 122 is further configured to engage the lower jaw 120, when in the locked position, to thereby prevent rotation of the lower jaw 120 relative to the upper jaw, and thus prevent moving the clip 114 to the open position.

Figure 17:
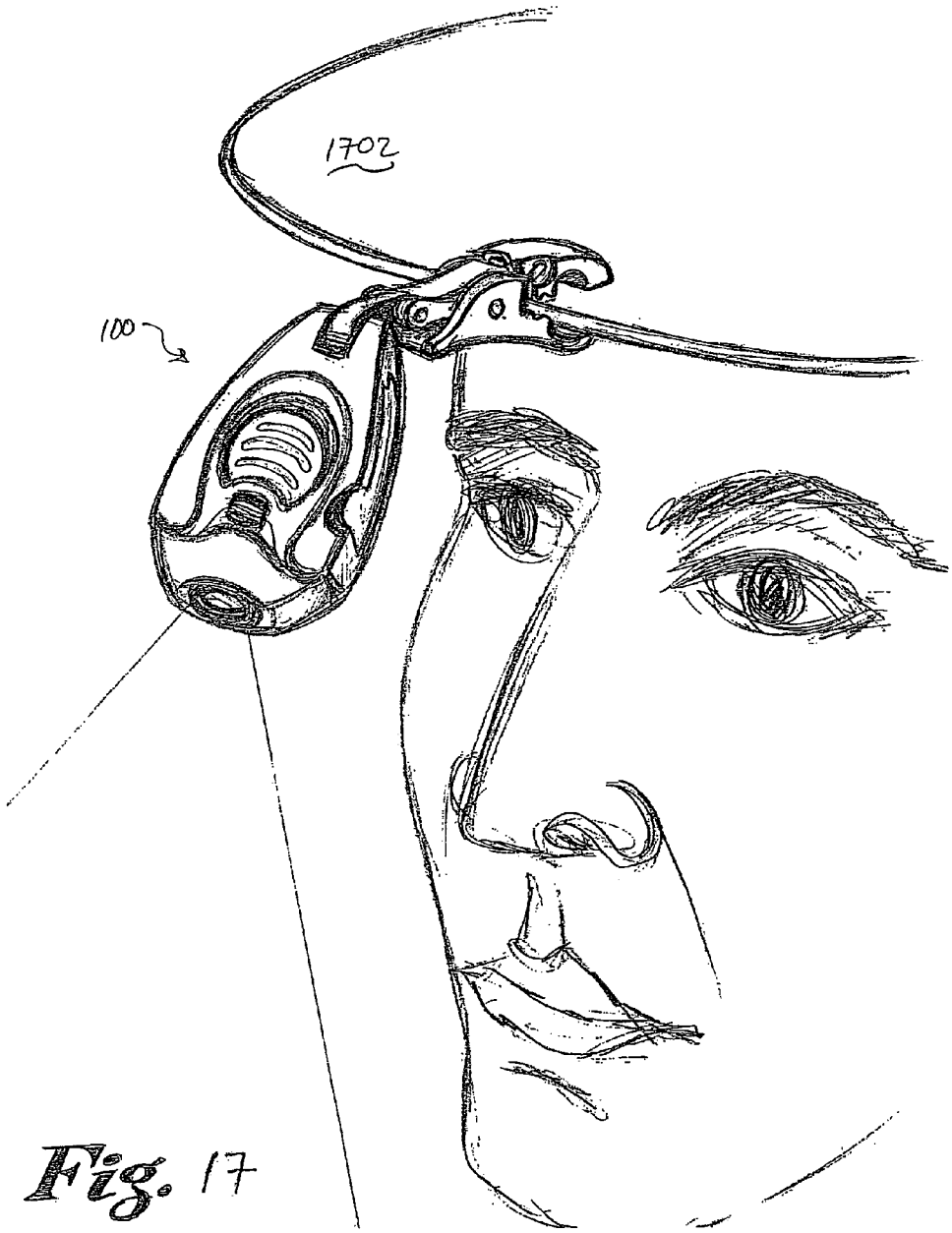
FIG. 17 is a perspective view of the compact flashlight showing it being clipped to a hat.
Figure 18:
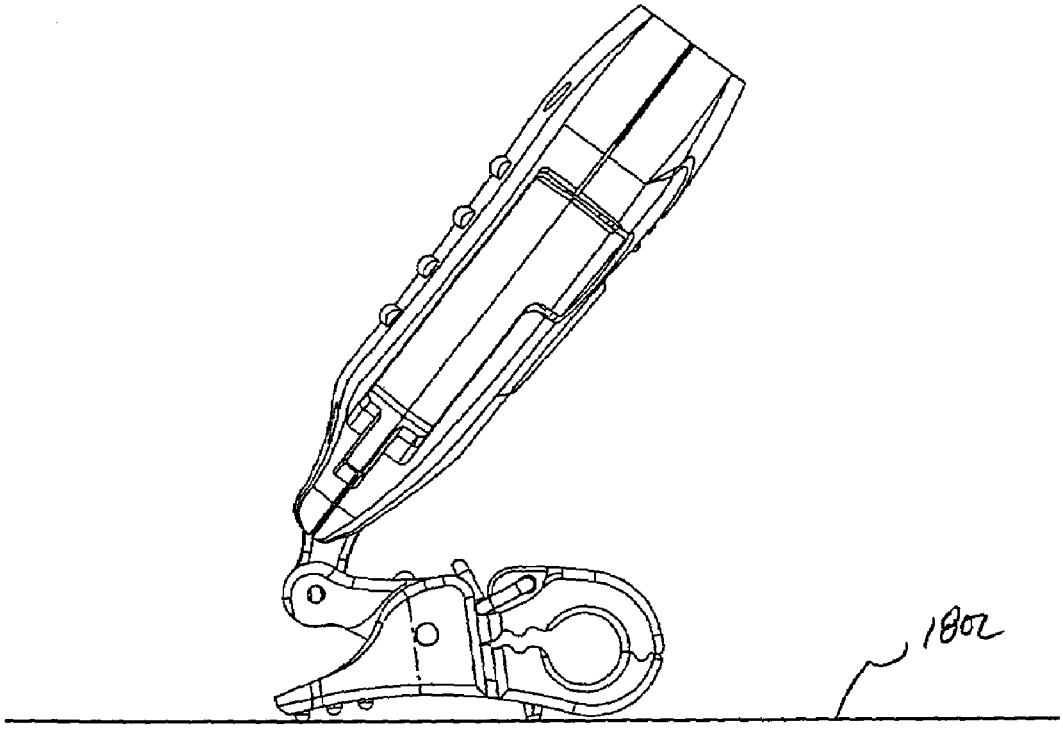
FIG. 18 is a side view of the compact flashlight showing it resting on a surface and directed in a desired direction.

It was previously noted that the clip assembly 104 may be used to couple the flashlight 100 to various devices, and or dispose the flashlight 100 on various surfaces. For example, and as shown in FIGS. 16–18, respectively, the clip assembly 104 may be used to couple the flashlight 100 to a keyring 1602, to clip the flashlight 100 to a hat 1702, or to dispose the flashlight 100 on a surface 1802 and point the housing assembly 102 in a desired direction to thereby illuminate a desired object or area.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A flashlight, comprising:

a housing assembly having at least one aperture formed therein;

a light mounted at least partially within the housing assembly and extending at least partially through the housing assembly aperture;

a battery holder disposed within the housing assembly and adapted to receive one or more batteries therein;

a first switch disposed on the housing assembly, the first switch configured to move between at least an activate position and a deactivate position, to thereby electrically energize and de-energize, respectively, the light from the battery when one or more batteries are installed in the battery holder;

a connection arm having at least a first end and a second end, the connection arm first end rotationally coupled to the housing assembly; and a clip rotationally coupled to the connection arm second end and having at least a closed position and an open position, the clip including:

a first jaw having at least an inner surface and an outer surface;

a second jaw rotationally coupled to the first jaw, the second jaw having at least an inner surface and an outer surface and adapted to rotate relative to the first jaw, and a spring coupled between the first and second jaws, the spring configured to bias the clip toward the closed position, whereby at least a first portion of the first jaw inner surface engages at least a first portion of the second jaw inner surface.

2. The flashlight of claim 1, wherein:

each of the first and second jaw inner surfaces include a plurality of lands and grooves formed thereon; and the lands on the first and second jaw inner surfaces mate with the grooves on the second and first jaw inner surfaces, respectively.

3. The flashlight of claim 1, wherein the first and second jaws are configured such that when the clip is in the closed position at least a second portion of the first jaw inner surface is spaced apart from at least a second portion of the second jaw inner surface.

4. The flashlight of claim 1, wherein the first and second jaw inner surfaces each include a substantially semi-cylindrical groove formed in the respective inner surfaces, the semi-cylindrical grooves substantially collocated with one another to thereby form a substantially circular opening through a portion of the clip when the clip is in the closed position.

5. The flashlight of claim 1, wherein the connection arm is configured to have at least two rotational degrees-of-freedom relative to the housing assembly.

6. The flashlight of claim 1, wherein the clip is configured to have at least two rotational degrees-of-freedom relative to the connection arm.

7. The flashlight of claim 1, further comprising:

a lock coupled to the clip and moveable between at least (i) a lock position, whereby the clip is locked in the closed position, and (ii) an unlock position, whereby the clip is moveable between the closed and open positions.

8. The flashlight of claim 7, wherein the lock comprises:

a main body rotationally coupled to the clip first jaw and rotatable between the lock and unlock positions, wherein the main body engages at least a portion of the clip second jaw in the lock position, to thereby inhibit rotation of the second jaw relative to the first jaw.

9. A flashlight comprising:

a housing assembly having at least one aperture formed therein;

a light mounted at least partially within the housing assembly and extending at least partially through the housing assembly aperture;

a battery holder disposed within the housing assembly and adapted to receive one or more batteries therein;

a first switch disposed on the housing assembly, the first switch configured to move between at least an activate position and a deactivate position, to thereby electrically energize and de-energize, respectively, the light from the battery when one or more batteries are installed in the battery holder;

a clip rotationally coupled to the housing assembly and having at least a closed position and an open position, the clip including:

a first jaw having at least an inner surface and an outer surface, a second jaw rotationally coupled to the first jaw, the second jaw having at least an inner surface and an outer surface and adapted to rotate relative to the first jaw, and a spring coupled between the first and second jaws, the spring configured to bias the clip toward the closed position, whereby at least a first portion of the first jaw inner surface engages at least a first portion of the second jaw inner surface; and a lock coupled to the clip and moveable between at least (i) a lock position, whereby the clip is locked in the closed position, and (ii) an unlock position, whereby the clip is moveable between the closed and open positions.

10. The flashlight of claim 9, wherein the lock comprises:

a main body rotationally coupled to the clip first jaw and rotatable between the lock and unlock positions, wherein the main body engages at least a portion of the clip second jaw in the lock position, to thereby inhibit rotation of the second jaw relative to the first jaw.

* * * * *